United States Patent [19]

Lien

[11] 4,104,540

[45] Aug. 1, 1978

[54] LAMP SWITCH CIRCUIT

[76] Inventor: Del R. Lien, 143 Eastview Dr. NW., Cedar Rapids, Iowa 52405

[21] Appl. No.: 826,994

[22] Filed: Aug. 23, 1977

[51] Int. Cl.[2] ..... H01R 13/70

[52] U.S. Cl. ..... 307/114; 200/51 LM

[58] Field of Search ..... 307/114, 113, 112, 140, 307/147; 340/147 R; 200/51 LM, 51.05, 51.06, 51.1

[56] References Cited

U.S. PATENT DOCUMENTS

| | | | |
|---|---|---|---|
| 3,723,757 | 3/1973 | Bernath | 307/114 |
| 3,872,319 | 3/1975 | Platzer, Jr. | 307/114 |
| 3,928,737 | 12/1975 | Prusert | 200/51 LM |

*Primary Examiner*—Herman J. Hohauser

[57] ABSTRACT

A circuit and circuit elements are disclosed to operate a lamp independently from either a two-position wall-mounted switch or a two-position lamp-mounted switch.

4 Claims, 6 Drawing Figures

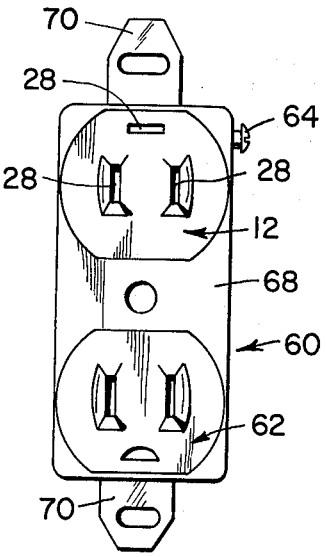
FIG. 1
FIG. 2
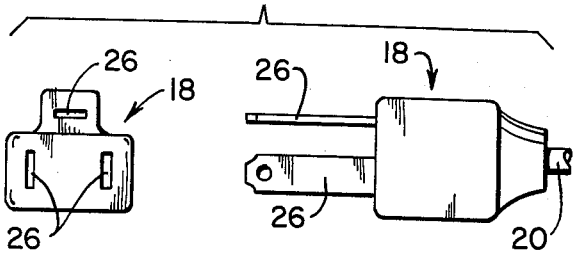
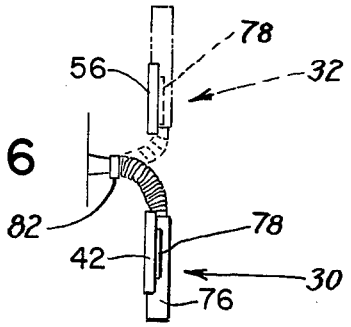
FIG. 6
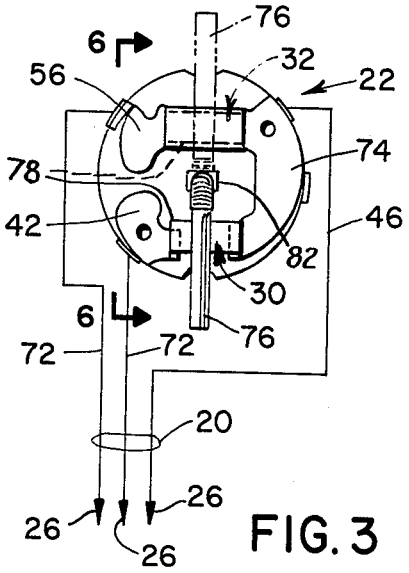
FIG. 3
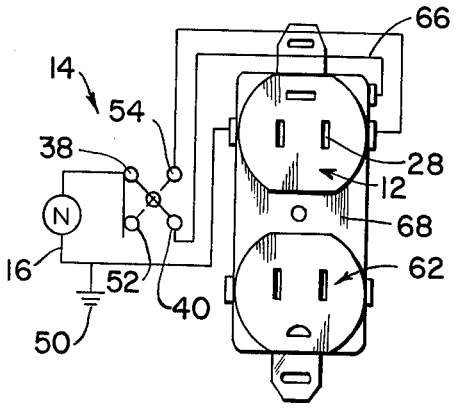
FIG. 4
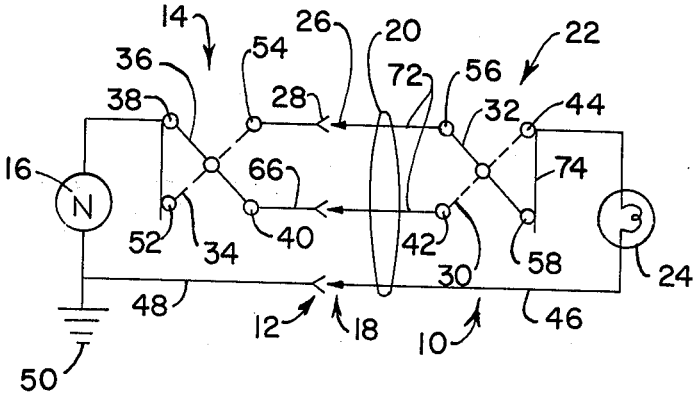
FIG. 5

LAMP SWITCH CIRCUIT

BACKGROUND OF THE INVENTION

This invention relates to a lamp circuit, and more particularly, a lamp circuit operable independently from a wall-mounted or lamp-mounted switch.

For many years, homes have been built without ceiling and wall lighting fixtures. In such homes is is still necessary to provide the dweller with a way of lighting a room before entering it. This is done by having a wall switch near the room entrance which controls one or more of the wall outlets in the room. It is intended that a lamp be plugged into the switch controlled outlet.

Unfortunately, this creates problems. For example, in a bedroom the lamp is best placed by the bed. In this case the lamp is turned off, upon retiring, at the lamp. The next morning, the lamp probably will not be turned back on again because of the daylight. The next night, the lamp cannot be turned on by the wall switch since the lamp was turned off by the lamp's switch. This is not only annoying, but it is also dangerous, because a person is then forced to enter a dark room.

This invention is directed to a lamp circuit and apparatus therefor which enables the remote operation of the lamp. The circuit and apparatus allows the lamp to be turned on or off independently from either a wall switch controlling a wall outlet or a second switch located at or on the lamp.

SUMMARY OF THE INVENTION

In accordance with the invention, a wall-mounted receptacle is modified so as to be electrically connected to a three-way wall switch. A lamp is provided with a three-way switch connected by three wires through a cord to three prongs of a plug received within the receptacle in contact with the switch leads. In either operative position of the wall-switch or the lamp switch, a series circuit can be established or broken to a source of electrical power by repositioning the switch element of the other.

BRIEF DESCRIPTION OF THE DRAWING

Further objects and advantages of the invention will become apparent from the following description and claims, and from the accompanying drawing, wherein:

FIG. 1 is a front view in elevation of a duplex electrical receptacle used with the lamp switch circuit of the present invention;

FIG. 2 is a front and side view in elevation of a three prong electrical plug used with the lamp switch circuit of the present invention;

FIG. 3 is a sectional view of a lamp socket switch used with the lamp switch circuit of the present invention, and further illustrating a schematic of how the socket switch is connected to the plug of FIG. 2;

FIG. 4 is a front view in elevation of the receptacle of FIG. 1, and a schematic of how the receptacle is connected to a source of electrical power;

FIG. 5 is an overall schematic diagram of the lamp switch circuit of the present invention; and FIG. 6 is a cross-sectional view taken substantially along the plane indicated by line 6—6 of FIG. 3.

DETAILED DESCRIPTION OF THE PREFERRED EMBODIMENT

Referring now to the drawing in detail, wherein like numerals indicate like elements throughout the several views, the lamp switch circuit 10 of the present invention includes a wall-mounted receptacle 12 connected to a three-way wall-mounted switch 14 connected to a source of A.C. power 16. A three prong plug 18 is connected via a cord 20 to a three-way lamp switch 22 in series with a lamp bulb 24 in a lamp socket. Plug 18 has prongs 26 received between contacts 28 in receptacle 12.

As shown in FIG. 5, with the switch 22 in any of its two operative positions 30 or 32, a series circuit may be established from source 16 to bulb 24 depending upon the operative position 34 or 36 occupied by switch 14. Similarly, a series circuit from source 16 to bulb 24 may be established at lamp switch 22 depending upon the position 30 or 32 occupied by switch 22, with the switch 14 in any of its two operative positions 34 or 36. In the former instance, this circuit is shown as extending from source 16, through contacts 38 and 40 of switch 14, one contact 28 of receptacle 12 one prong 26 of plug 18, contacts 42 and 44 of switch 22, lamp bulb 24, line 46, a second contact 26 of plug 18, a second contact 28 of receptacle 12, line 48 and ground 50. If switch 14 is in a second operative position bridging contacts 52 and 54, the same series circuit can be established by moving lamp switch 22 to bridge contacts 56 and 58. Conversely, the circuit is completed if switch 22 bridges contacts 56 and 58 and switch 14 bridges contacts 52 and 54, and if switch 22 bridges contacts 42 and 44, the circuit is completed at switch 14 by bridging contacts 38 and 40. Accordingly, by use of circuit 10, the lamp bulb 24 can be shut off or turned on at either switch 14 or 22.

Circuit 10 may be fabricated by modifying conventional electrical receptacles, plugs and lamp switches, which elements may be sold in kit form for installation in either new homes or existing structures.

For example, a duplex receptacle 60 can be provided which contains a receptacle 12, as described above, and a standard receptacle 62 for receiving a standard plug. Receptacle 12 adds an additional contact mounting screw 64 for receiving the additional line 66 from switch 14. Both receptacles 12 and 62 are mounted on a common base 68 having tabs 70 to receive suitable fasteners to connect receptacle base 68 to a wall.

Plug 18 is shown in FIG. 2, and includes three prongs 26 connected individually to conductors 72 and 46 in cord 20. As shown in FIG. 3, the conductors 72 are electrically connected to a modified lamp switch mounted on the lamp socket, and more particularly copper contacts 42 and 56. Conductor 46 is connected to a copper contact 74 (corresponding to contacts 44 and 58 of FIG. 5). Switch element 76 is connected to a metal contact bar 78 and a coil spring 80. Switch element 76 can be reciprocated by pushing it to cause spring 80 to snap over a center pedistal 82 to alternately connect contacts 42 and 74 (44) and contacts 56 and 74 (58) in series as desired. The alternate positions of switch element 76, bar 78 and spring 80 are indicated in full and phantom lines, respectively. Other lamp switches, such as pull chain switches and the like may be utilized, however, within the scope of the circuit 10.

While a specific embodiment of a lamp switch circuit has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A lamp switch circuit comprising:

a lamp having a three-way switch provided with two operative positions, adapted to receive a lamp bulb, said lamp switch including three contact elements, two of which are connected in series in the operative position of said switch, and a reciprocating switch element, and means on said switch element for alternately connecting two of said three contact elements, said alternate connecting means including a coil spring connected to one end of said switch element adapted to be snapped over a center pedestal in response to reciprocable movement of said switch element, and a contact bar for alternately bridging two of said three contact elements in response to reciprocable movement of said switch element.

a three-way wall-mounted switch provided with two operative positions remotely located from said lamp adapted to be connected to a source of electrical power, and means for directly connecting said lamp switch and wall-mounted switch in series to operate said lamp from either one of said switches.

2. The circuit of claim 1 wherein said direct connecting means includes a three prong plug connected directly to said lamp switch, and a receptacle having three contact elements to receive individual prongs on said plug connected to said wall-mounted switch.

3. The circuit of claim 1 wherein each of said plug prongs is connected directly to said lamp switch by a conductor from a prong to one of said contact elements of said lamp switch.

4. The circuit of claim 4 wherein said conductors are housed within a cord.

* * * * *